US008162638B2

(12) United States Patent
Stott et al.

(10) Patent No.: US 8,162,638 B2
(45) Date of Patent: Apr. 24, 2012

(54) METHOD AND SYSTEM FOR FORMING VERTICAL PRE-CAST CONCRETE STRUCTURES

(75) Inventors: Gale J. Stott, Taylorsville, UT (US); Tony D. Stott, Draper, UT (US)

(73) Assignee: Intellectual Property Management LLC, Salt Lake City, UT (US)

( * ) Notice: Subject to any disclaimer, the term of this patent is extended or adjusted under 35 U.S.C. 154(b) by 401 days.

(21) Appl. No.: 12/350,862

(22) Filed: Jan. 8, 2009

(65) Prior Publication Data

US 2009/0173871 A1 Jul. 9, 2009

Related U.S. Application Data

(60) Provisional application No. 61/019,721, filed on Jan. 8, 2008.

(51) Int. Cl.
*B28B 7/00* (2006.01)

(52) U.S. Cl. ..... 425/3; 249/112; 249/120; 249/129; 249/155; 249/158; 425/DIG. 33

(58) Field of Classification Search ..... 249/64, 249/85, 112, 113, 115, 123, 124, 128, 139, 249/155, 158, 160–162, 168, 169, 177, 189, 249/120, 129, 131; 425/3, 466–468, DIG. 10, 425/DIG. 33

See application file for complete search history.

(56) References Cited

U.S. PATENT DOCUMENTS

| | | | | |
|---|---|---|---|---|
| 434,221 | A * | 8/1890 | Whittaker | 249/139 |
| 547,966 | A * | 10/1895 | Reese | 249/82 |
| 600,565 | A * | 3/1898 | Wallace | 249/112 |
| 1,247,107 | A | 11/1917 | Graham | |
| 1,276,264 | A | 8/1918 | Porter et al. | |
| 1,623,178 | A * | 4/1927 | Gearhart | 249/129 |
| 1,712,678 | A * | 5/1929 | Redman | 249/16 |
| 1,754,087 | A | 4/1930 | Flam | |
| 1,767,163 | A * | 6/1930 | Ackermann | 249/102 |
| 1,937,306 | A | 11/1933 | Barriball | |
| 2,172,466 | A * | 9/1939 | Edwardes et al. | 264/225 |
| 2,185,335 | A | 1/1940 | Fischer | |
| 2,474,654 | A | 6/1949 | Carlson | |
| 2,651,391 | A | 9/1953 | Havens | |
| 2,763,909 | A * | 9/1956 | Guimont | 249/76 |

(Continued)

FOREIGN PATENT DOCUMENTS

FR 2588206 A1 * 4/1987

(Continued)

*Primary Examiner* — Dimple Bodawala
(74) *Attorney, Agent, or Firm* — Workman Nydegger

(57) ABSTRACT

The apparatus may include moveable partitions that may be positioned in a side-by-side arrangement. The partitions may be moveable with respect to each other to facilitate installation of liners and reinforcing material and the removal of the concrete structures from the apparatus after the concrete has hardened. Cavities may be defined between the partitions for receiving concrete to form panels for use in barriers, walls and other structures. Removable liners may be temporarily secured to the partitions in a manner that does not comprise the integrity of the liners. Further, the liners may be secured to the partitions utilizing a combination of mechanical and magnetic coupling. The liners may also include a molded portion for forming surface treatments in the panels. Removable bulkheads placed into the cavities allow the dimensions of the cavities to be variable to thereby permit the formation of panels of different dimensions using the same partitions.

28 Claims, 13 Drawing Sheets

U.S. PATENT DOCUMENTS 2,783,521 A * 3/1957 Vondrous et al. ..... 249/112
2,981,997 A 5/1961 Painter
3,110,949 A * 11/1963 Di Tullio et al. ..... 249/101
3,220,692 A * 11/1965 Eklund ..... 249/161
3,260,494 A 7/1966 Deiggaard
3,360,231 A 12/1967 Adrianus
3,381,929 A 5/1968 Bancker
3,481,093 A 12/1969 Davidson
3,488,817 A * 1/1970 Katz ..... 425/441
3,507,084 A 4/1970 Jay et al.
3,635,642 A 1/1972 Mueller
3,731,902 A 5/1973 Shoemaker
3,743,232 A 7/1973 Vaughan
3,758,650 A * 9/1973 Hurst ..... 264/34
3,780,977 A * 12/1973 Dashew ..... 249/15
3,843,089 A 10/1974 Scholz et al.
3,844,524 A * 10/1974 Fisher et al. ..... 249/120
3,892,516 A * 7/1975 McGrew et al. ..... 425/443
3,948,009 A 4/1976 Bernhard
3,954,377 A 5/1976 Scholz et al.
4,037,816 A 7/1977 Scott
4,156,516 A 5/1979 Oliver
4,178,343 A 12/1979 Rojo, Jr.
4,181,286 A 1/1980 Van Doren
4,191,521 A * 3/1980 Muldery et al. ..... 425/432
4,241,554 A 12/1980 Infantino
4,286,934 A 9/1981 Linetsky
4,290,246 A 9/1981 Hilsey
4,516,372 A 5/1985 Grutsch
4,579,312 A 4/1986 White
4,614,325 A 9/1986 Muldery et al.
4,669,240 A 6/1987 Amormino
4,694,624 A 9/1987 Juhas
4,769,191 A 9/1988 Diana
4,862,660 A 9/1989 Raymond
5,028,368 A 7/1991 Grau
5,065,561 A 11/1991 Mason
5,098,059 A 3/1992 Sawyer
5,154,837 A 10/1992 Jones
5,202,132 A 4/1993 Myers et al.
5,274,971 A 1/1994 Elmore et al.
5,404,685 A 4/1995 Collins
5,459,970 A 10/1995 Kim
5,486,391 A 1/1996 Tyner
5,509,249 A 4/1996 House et al.
5,524,405 A 6/1996 Byrd
5,588,786 A 12/1996 House et al.
5,689,927 A 11/1997 Knight, Sr.
5,728,312 A 3/1998 Van Doren
5,833,873 A 11/1998 Adonetti
5,845,448 A 12/1998 Potvin
5,860,262 A 1/1999 Johnson
5,881,524 A 3/1999 Ellison, Jr.
5,887,404 A 3/1999 Kreizinger
5,922,236 A 7/1999 Zuhl
5,930,970 A 8/1999 De Le fevre
6,000,182 A 12/1999 Keenan
6,003,278 A 12/1999 Weaver et al.
6,021,994 A 2/2000 Shartzer, Jr.
6,129,329 A * 10/2000 Nasvik et al. ..... 249/16
6,199,832 B1 3/2001 Morrow
6,264,867 B1 7/2001 Keenan
6,283,439 B1 9/2001 Myers et al.
6,301,851 B1 10/2001 Matsubara
6,385,933 B1 5/2002 Owens
6,510,667 B1 1/2003 Cottier et al.
6,550,215 B1 4/2003 Pulte et al.
6,550,834 B2 4/2003 Fromelius
6,568,141 B2 5/2003 Kremers
6,594,963 B1 7/2003 Bennett
6,622,452 B2 9/2003 Alvaro
6,631,599 B1 10/2003 Takagi
6,712,598 B2 3/2004 Jensen
6,811,357 B1 11/2004 Haug
6,848,232 B2 2/2005 Pulte et al.
6,898,912 B2 5/2005 Bravinski
6,939,121 B2 9/2005 Giri et al.
7,073,767 B1 7/2006 Bennett
7,121,520 B2 * 10/2006 Khoo ..... 249/157
7,146,775 B2 12/2006 Burkett
7,165,916 B2 1/2007 Nanayakkara
7,252,281 B1 * 8/2007 Sie ..... 249/91
7,254,925 B2 8/2007 Stefanutti et al.
7,665,712 B2 * 2/2010 Stott ..... 249/162
8,025,493 B2 * 9/2011 Petrov ..... 425/3
2002/0000506 A1 1/2002 Khoo
2003/0163963 A1 9/2003 Pulte et al.
2003/0182889 A1 10/2003 Takagi
2003/0192272 A1 10/2003 Bravinski
2004/0104333 A1 6/2004 Ward et al.
2004/0154246 A1 8/2004 DeSutter
2004/0217254 A1 11/2004 Myers et al.
2005/0016123 A1 * 1/2005 Jucha et al. ..... 52/749.1
2005/0029429 A1 2/2005 Schworer
2005/0284095 A1 * 12/2005 Switzer ..... 52/782.1
2006/0174569 A1 8/2006 Stott
2007/0062142 A1 3/2007 Stott
2009/0173872 A1 * 7/2009 Stott et al. ..... 249/48

FOREIGN PATENT DOCUMENTS

GB 2026932 A * 2/1980
GB 2241192 8/1991
JP 06129095 A * 5/1994
JP 2000135709 A * 5/2000
WO WO 9301924 A1 * 2/1993
WO WO 00/62987 10/2000

* cited by examiner

METHOD AND SYSTEM FOR FORMING VERTICAL PRE-CAST CONCRETE STRUCTURES

CROSS-REFERENCE TO RELATED APPLICATIONS

This application claims the benefit of U.S. Provisional Application Ser. No. 61/019,721, filed on Jan. 8, 2008, which application is hereby incorporated by reference.

BACKGROUND OF THE INVENTION

1. The Field of the Invention

The present disclosure relates generally to devices for forming structures, and more particularly, but not necessarily entirely, to devices for forming precast concrete structures.

2. The Relevant Technology

Precast concrete structures have been used in the building construction industry for many years. Precast concrete structures may include steel reinforced panels for use in constructing fences, walls, sound barriers, and the like. Precast concrete structures may also include columns for supporting panels or overhead items. High quality precast concrete structures may be formed efficiently, since they may be constructed in a factory with specialized equipment, strict quality standards, and controlled conditions not subject to rain, hot or cold temperatures, or builder errors. Moreover, labor savings may be accomplished since precast structures may be formed more efficiently in a factory than constructing a form on site to manufacture the structures in place. Use of precast concrete structures may also reduce construction delays associated with rain or inclement weather since concrete may not be properly poured on site in inclement weather.

In recent years, the use of precast concrete columns and panels with decorative patterns formed on the exterior surface has increased in popularity. The precast concrete panels may have various patterns such as stone or brick, for example. Such precast concrete panels may be easier to construct than stone or brick walls. Moreover, the precast concrete panels may be durable and provide advantages in that cracking may be reduced as compared to walls formed with grouted natural stone or brick, and no mortar joints are created with precast concrete panels to allow water to seep into the wall.

Various types of devices are known in the art for forming precast concrete structures. Despite the advantages of known devices for forming concrete structures, improvements are still being sought to improve the efficiency of the manufacturing process and the quality of the concrete structures. Also, improvements are being sought for concrete structures to facilitate installation of the structures at the construction site.

Also, various types of attaching devices and methods are known in the art for joining concrete structures to footings to support the structures in an upright position. Despite the advantages of known attaching devices and methods, improvements are still being sought to improve the efficiency of construction and the quality of the concrete structures.

The features and advantages of the disclosure will be set forth in the description that follows, and in part will be apparent from the description, or may be learned by the practice of the disclosure without undue experimentation. The features and advantages of the disclosure may be realized and obtained by means of the instruments and combinations particularly pointed out in the appended claims.

BRIEF DESCRIPTION OF THE DRAWINGS

Various embodiments of the present invention will now be discussed with reference to the appended drawings. It is appreciated that these drawings depict only typical embodiments of the invention and are therefore not to be considered limiting of its scope.

DETAILED DESCRIPTION OF THE PREFERRED EMBODIMENTS

Figure 1:
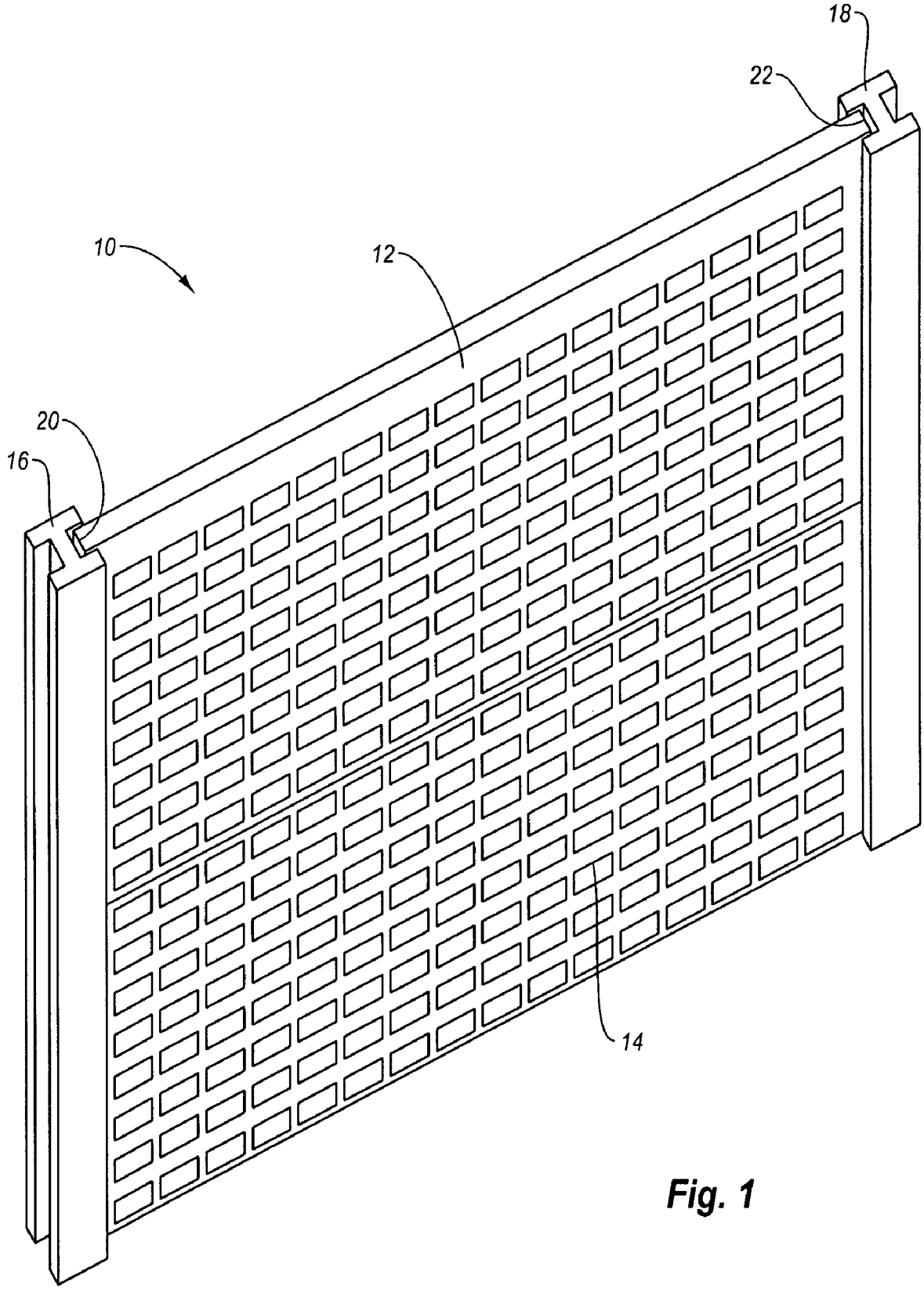
FIG. 1 is a perspective view of a structure having two panels arranged in a stacked configuration as part of a wall or barrier.

For the purposes of promoting an understanding of the principles in accordance with the disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure claimed.

Before the present concrete structure system and apparatus and method for forming one or more concrete structures is disclosed and described, it is to be understood that this disclosure is not limited to the particular configurations, process steps, and materials disclosed herein as such configurations, process steps, and materials may vary somewhat. It is also to be understood that the terminology employed herein is used for the purpose of describing particular embodiments only and is not intended to be limiting since the scope of the present disclosure will be limited only by the appended claims and equivalents thereof.

It must be noted that, as used in this specification and the appended claims, the singular forms "a," "an," and "the" include plural referents unless the context clearly dictates otherwise. Similarly, as used herein, the terms "comprising,"

"including," "containing," "characterized by," and grammatical equivalents thereof are inclusive or open-ended terms that do not exclude additional, unrecited elements or method steps.

As used herein, the term "concrete" shall be construed broadly to include conglomerate construction materials, including construction materials formed of aggregate and cementitious materials, as well as any other known material that may be placed in a fluid or semi-fluid form and hardened or solidified, including filler materials joined together with a bonding agent or resin.

As used herein, the phrase "surface treatment" shall be construed broadly to include any variety of textures or designs or features that may be placed on the exterior of a concrete structure.

As used herein, the term "attached" shall be construed broadly to include situations in which members are secured or joined together, including situations in which one member is embedded into another member, and situations in which intervening members are used to join one member to another member such that the two members need not physically contact each other.

Applicants have invented an apparatus for producing one or more pre-cast concrete panels. The apparatus can also be modified to produce other concrete structures such as columns. The apparatus may include moveable partitions that may be positioned in a side-by-side arrangement. The partitions may be moveable with respect to each other to facilitate installation of liners and reinforcing material and the removal of the concrete panels from the apparatus after the concrete has hardened. Cavities may be defined between the partitions for receiving concrete to form panels for use in barriers, walls, and other structures. Removable liners may be temporarily secured to the partitions in a manner that does not compromise the integrity of the liners. Further, the liners may be secured to the partitions utilizing mechanical and/or magnetic couplings. The liners may also include a molded portion for forming surface treatments in the panels. Removable bulkheads placed into the cavities allow the dimensions of the cavities to be variable to thereby permit the formation of panels of different dimensions using the same partitions.

Referring now to FIG. 1, there is depicted a structure 10 that may form part of a barrier or wall. The structure 10 includes an upper panel 12 and a lower panel 14 that are arranged in a stacked panel configuration, that is, panel 12 is stacked on panel 14. The panels 12 and 14 are held in the stacked configuration and in an upright position by columns 16 and 18 disposed at the ends of the panel 12 and 14. In particular, the lateral ends of the panels 12 and 14 are received into slots 20 and 22 that are formed into columns 16 and 18, respectively. The slots 20 and 22 hold the panels 12 and 14 in place.

One significant disadvantage to the stacked configuration of the panels 12 and 14 as shown in FIG. 1, is that where the structure 10 is placed next to a roadway, such as for sound reduction purposes, vehicles may crash into the structure 10, and, in particular, the lower panel 14. When this happens, the lower panel 14 may break into pieces allowing the automobile to pass partly under the upper panel 12 of the structure 10. With the lower panel 14 weakened or destroyed, the weight of the upper panel 12 may cause it to fall onto the automobile with the potential to cause serious injury and damage. For this reason, many regulatory authorities are prohibiting the use of structures with panels that are arranged in a stacked configuration near roadways and instead require a single panel. However, the panels 12 and 14 may be utilized in an unstacked configuration.

Figure 2:
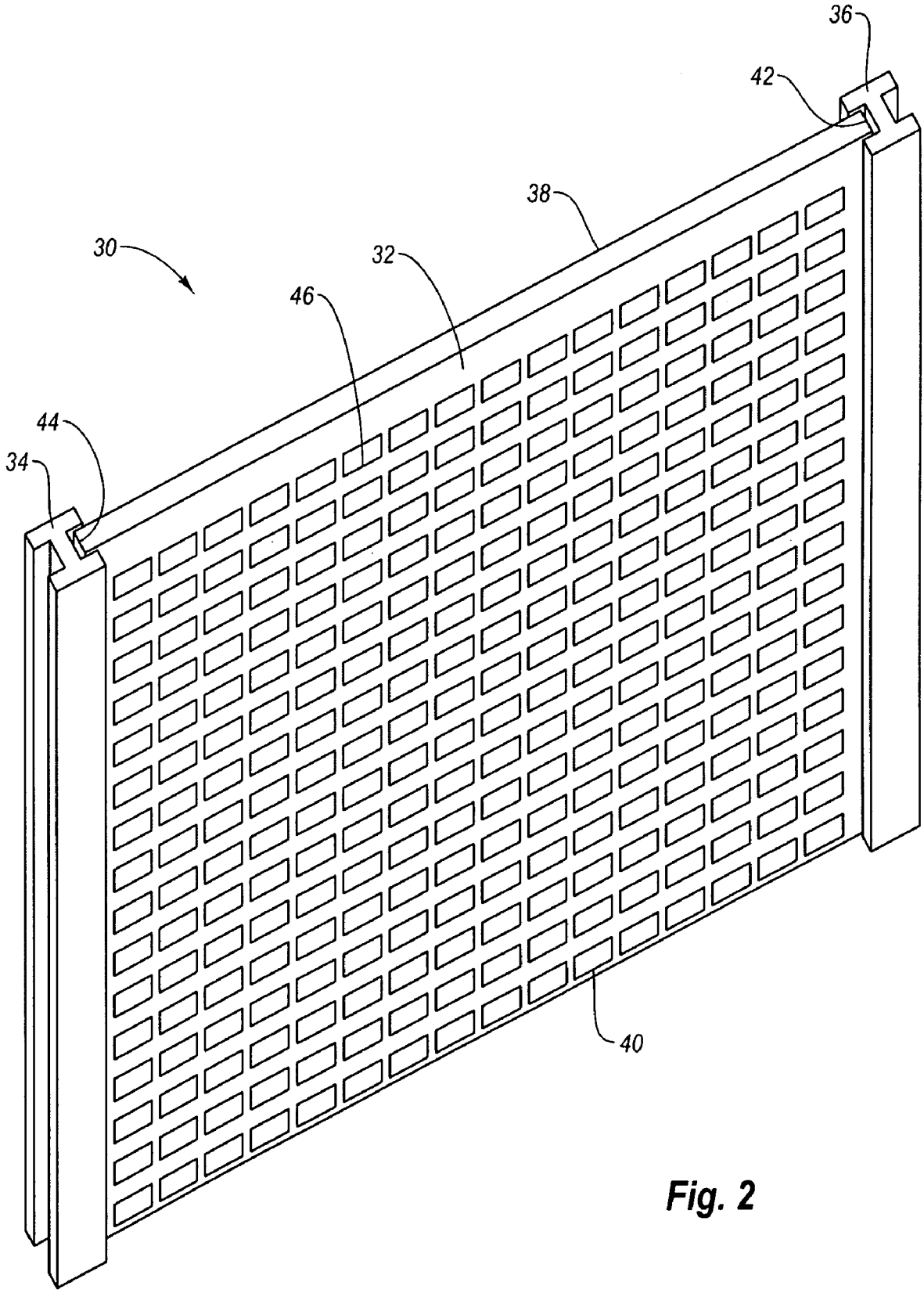
FIG. 2 is a perspective view of a structure having a single panel of the same combined height as the two panels depicted in FIG. 1.

Referring now to FIG. 2, there is depicted a structure 30 pursuant to one embodiment of the present invention that forms part of a barrier or wall. The structure 30 includes a single panel 32 held in a vertical orientation by support columns 34 and 36. The panel 30 has a rectangular shape that includes a top edge 38, a bottom edge 40 and side edges 42 and 44. When installed into the columns 34 and 36, both the top edge 38 and the bottom edge 40 are substantially parallel to the ground while the side edges 42 and 44 are substantially perpendicular to the ground. The panel 32 may include a surface treatment 46 having the appearance of a stacked block wall. It will be appreciated that the surface treatment 46 on the panel 32 may take any form that is aesthetically pleasing, including rocks, landscape scenes, patterns, and the like. The panel 32 is formed from concrete, or other similar substance, to provide the desired functionality of a physical barrier or a sound barrier. It will be noted that the panel 32 is the same height as the combined height of both of the panels 12 and 14 depicted in FIG. 1. However, because the panel 32 is in a single piece, many of the dangers associated with the use of two panels in a stacked configuration are eliminated.

Figure 3:
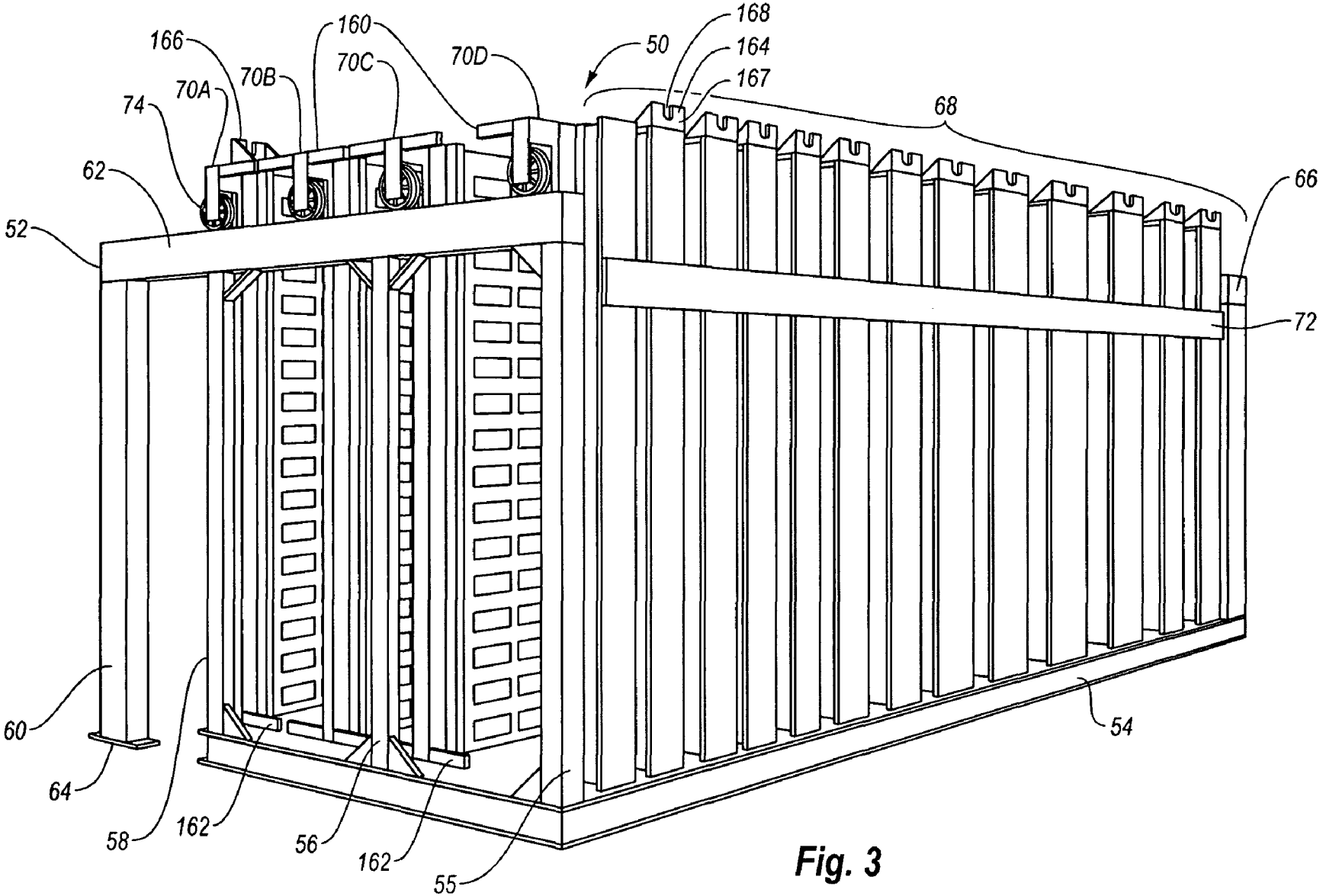
FIG. 3 is a perspective view of an apparatus for forming panels of varying heights as the types shown in FIGS. 1 and 2.

Referring now to FIG. 3, there is depicted an apparatus, indicated generally at 50, for forming concrete panels, like the panel 32 depicted in FIG. 2 and the panels 12 and 14 depicted in FIG. 1, in accordance with the present disclosure. The apparatus 50 includes a metal framework 52 mounted on a base 54. The base 54 may form a foundation for the apparatus 50 such that the apparatus 50 may be placed on the ground or any variety of floor surfaces. The base 54 may include a plurality of support beams and a plurality of support braces that are positioned substantially perpendicular with respect to and between the support beams.

The framework 52 is adapted to support moveable partitions 70A-70D. In particular, the framework 52 includes a side support member that includes support posts 55, 56, 58 and 60 for supporting the weight of the partitions 70A-70D. The support posts 55, 56 and 58 each extend upwardly from the base 54 to a beam 62. The beam 62 extends parallel to the ground. The support post 60 includes a bottom foot piece 64 that is adapted to engage the ground or other surface upon which the base 54 is placed. The support post 60 also extends upward from the foot piece 64 to the beam 62. Thus, it will be understood that the beam 62 is supported by support posts 55, 56, 58 and 60. It will be further understood that beam 66, on the opposite side of the apparatus 50 from beam 62 and not clearly visible in its entirety, is also supported by a side support structure that includes vertical posts such that beam 66 extends parallel to the ground similar to beam 62. Further, extending upwardly from the base 54 are a plurality of rigid members 68. The rigid members 68 are arranged in a wall and extend between beams 62 and 66. The rigid members 68 may take the form of I-beams and provide additional support and stability to the apparatus 50. A cross-piece member 72 may also be utilized to provide additional support for the rigid members 68.

Each of the partitions 70A-70D is suspended from the beams 62 and 66 of the framework 52 by a pair of wheels 74 (only one of the wheels 74 of each of the partitions 70 is visible in FIG. 3). The wheels 74 allow the partitions 70 to move with respect to the base 54 and the rigid members 68. It will be noted that one or more of the partitions 70A-70D may be fixed in place in the apparatus. That is, partitions that are fixed in place may not be moved with respect to the framework 52. It is appreciated that any number of movable partitions can be used. For example, in contrast to having the four depicted movable partitions, three, two, one, or five or more movable partitions can be used.

Figure 4:
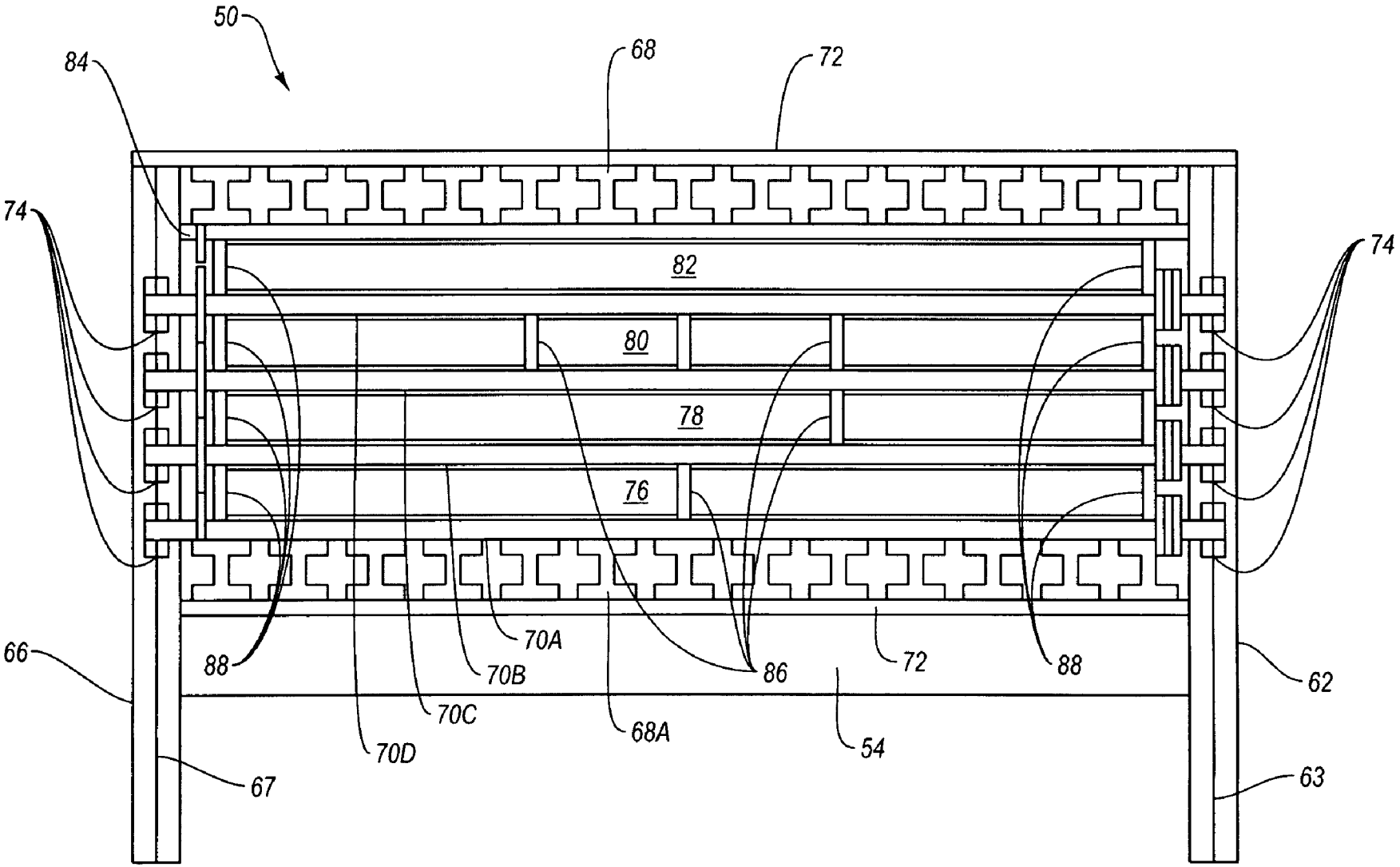
FIG. 4 is a top view of the apparatus depicted in FIG. 3 showing the cavities for forming panels.

Referring now to FIG. 4, there is depicted a top view of the apparatus 50 where like reference numerals indicate like components. As can be observed, the partitions 70A-70D define a plurality of cavities 76, 78, 80, and 82. In particular, the cavity 76 is formed between the partitions 70A and 70B. The cavity 78 is formed between the partitions 70B and 70C. The cavity 80 is formed between the partitions 70C and 70D. The cavity 82 is formed between panel 70D and a partition 84 rigidly attached to the rigid members 68. Partition 84 can be attached to rigid members 68 through conventional attachment such as welding, bolting, or the like. It will be understood that the partition 84 extends from the base 54 to the top of the rigid members 68 and between the beams 62 and 66.

As also depicted in FIG. 4, a plurality or rigid members 68A are mounted along the back side of partition 70A and move concurrently with partition 70A. Rigid members 68A can have the same configuration and be attached in the same manner as rigid members 68. Rigid members 68 and 68A provide increased structural support to partitions 84 and 70A, respectively, so that partitions 84 and 70A do not bow or outwardly flex when adjacent cavities 82 and 76 are filled with concrete. The bowing or flexing of partitions 84 and 70A would distort the formation of the resulting panels. Partitions 70B, 70C, and 70D may not need the additional rigid supports because concrete is placed on both sides of those partitions, thereby providing an equal load on both sides of the partitions so as to preclude bowing or flexing in either direction.

The wheels 74 of the partitions 70A-70D move along track members 63 and 67 mounted on a top surface of beams 62 and 66, respectively. The track members 63 and 67 may comprise upwardly extending guide members that engage grooves on the wheels 74. Returning to FIG. 3, mounted at the upper end of each partition 70A-70D and 84 at each end thereof is a stop 160 that projects toward to the adjacent partition. Partitions 70B-D have stops 160 projecting from each side. Stops 160 are aligned so that when the partitions are rolled together, stops 160 butt into each other to define when partitions are at their desired spacing. That is, stops 160 preclude the upper ends of the partitions from advancing closing together then the desired spacing between the partitions. Similarly, stops 162 are formed at the lower end of each partition 70A-70D and 84 at each end thereof and are aligned to butt together when the lower end of the partitions are at the desired spacing.

Figure 3A:
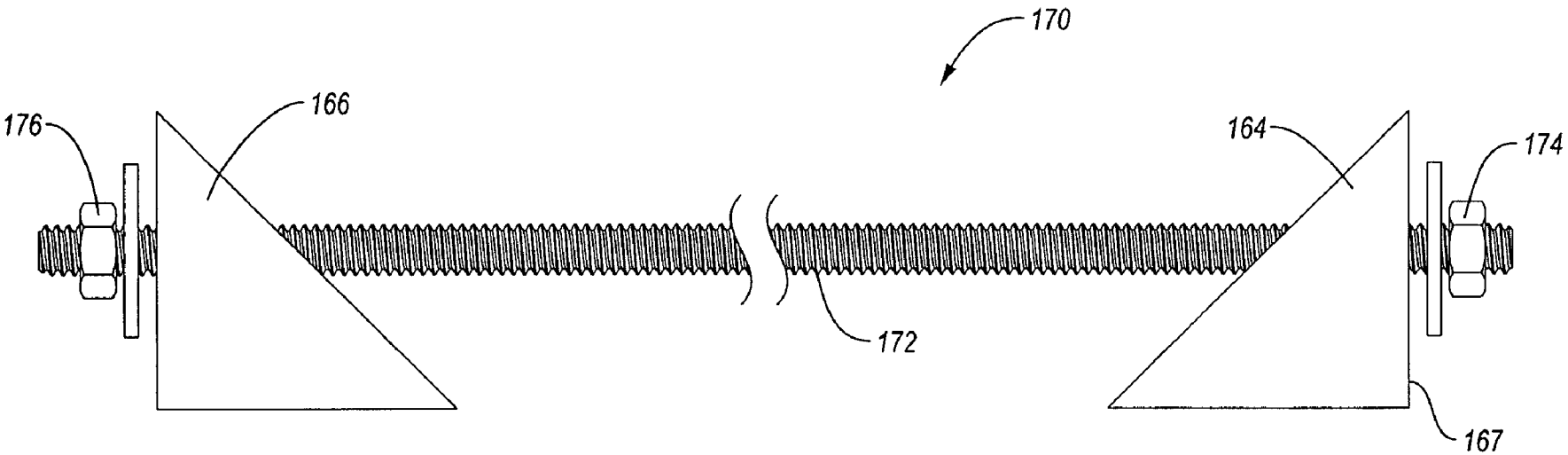
FIG. 3A is a side view of a tensioning rod mounted on tension brackets which are shown in FIG. 3.

As also depicted in FIG. 3, mounted on the top end of each rigid member 68 is a tensioning bracket 164. Likewise, a tensioning bracket 166 is mounted at the top end of each rigid member 68A. Tensioning brackets 164 and 166 are each formed having a bearing face 167 with a substantially U-shaped slot 168 formed thereon. After the partitions are manually moved to their approximate desired position, a tensioning rod is coupled with each aligned pair of tensioning brackets 164 and 166 to securely hold the partitions together. Specifically, depicted in FIG. 3A is a tensioning rod 170. Tensioning rod 170 comprises a threaded shaft 172 having a nut 174 threaded on one end thereof and a nut 176 threaded on the other end thereof with a washer 177 positioned adjacent to each nut. Shaft 172 is received within slots 168 so that the nuts 174, 176 and washer 177 are disposed outside of the bearing faces 167 of aligned brackets 164 and 166. Washers 177 are larger than slots 168 so that as one or both of nuts 174 and 176 are tightened on shaft 172, washers 177 bias against bearing faces 167 causing shaft 172 to be tensioned between brackets 164 and 166. This tensioning of each shaft 172 moves the partitions together until stops 160 and 162 (FIG. 3) are butting together as discussed above. The tensioning of shafts 172 also precludes separation of the partitions as cavities 76, 78, 80, and 82 are filled with concrete.

The cavities 76-82 are configured and adapted for receiving concrete to form panels, such as the panel 32 depicted in FIG. 2. In addition, the cavities 76-82 may be utilized to form smaller panels, such as the panels 12 and 14 depicted in FIG. 1. Thus, it will be understood that the cavities 76-82 may be utilized to form panels of varying dimensions. The manner in which panels of varying dimensions are created will now be explained.

With reference to FIG. 4, through the use of interior bulkheads 86, the dimensions of panels created using the apparatus 50 may be varied. The interior bulkheads 86 may be placed into any of the cavities 76-82 to thereby change a dimension of the cavities 76-82, although only cavities 76, 78, and 80 are shown in FIG. 4 with interior bulkheads 86. The bulkheads 86 extend from the top of the partitions 70A-70D to the base 54. End bulkheads 88 may be placed at the end of the cavities 76-82 to prevent concrete from leaking out between the partitions 70-70D during the concrete pouring process.

For example, an interior bulkhead 86 is shown in the cavity 76. The use of the bulkhead 86 in the cavity 76 divides the cavity 76 into approximately two equal halves. Concrete may be poured into each half of the cavity 76 such that two panels may be formed at the same time between the partitions 70A and 70B. In regard to cavity 78, an interior bulkhead 86 divides the cavity 78 into a larger portion and a smaller portion. Concrete may be poured into the larger portion of the cavity 78 to form larger panels than the panels that can be formed in cavity 76. With regard to cavity 80, three bulkheads 86 are positioned therein for simultaneously forming three different panels. It is appreciated that any desired number of bulkheads 86 can be positioned within any cavity including two or four or more. In regard to the cavity 82, no interior bulkheads 86 have been placed in cavity 82. Thus, the panels formed in cavity 82, without any interior bulkheads 86, are the largest in dimension that can be formed with the apparatus 50. In will be appreciated that interior bulkheads 86 may be placed at any location within the cavities 76-82 to create a panel of any dimension.

Figure 5:
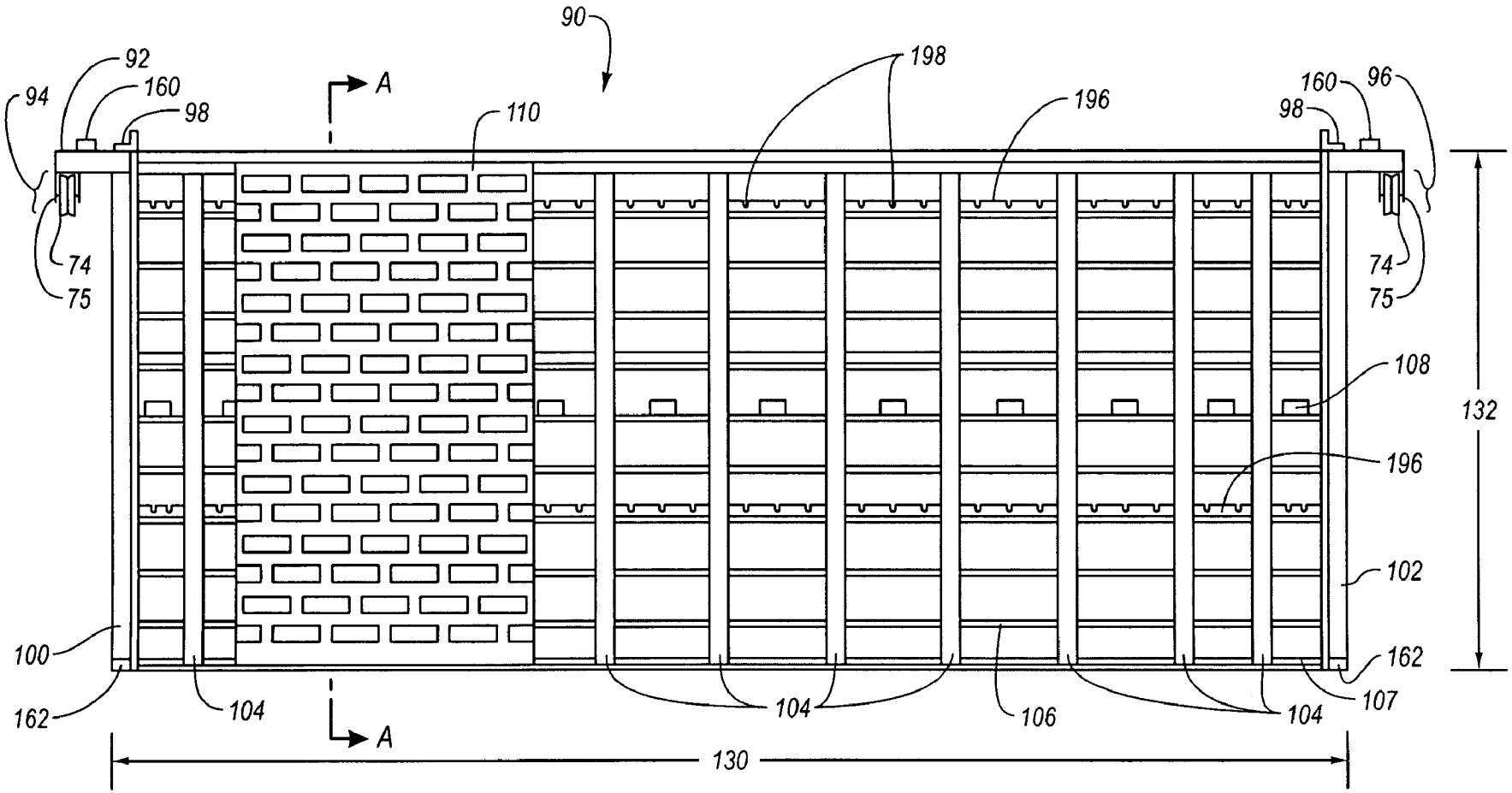
FIG. 5 is a side view of a partition suitable for use in the apparatus depicted in FIGS. 3 and 4.

Referring now to FIG. 5, there is depicted a side view of a partition 90 suitable for use with an apparatus for forming concrete panels, such as the apparatus 50 described above. It will be noted that the partitions 70A-70D may take the form of the partition 90 depicted in FIG. 5. The partition 90 includes a top beam 92 extending from a first wheel assembly 94 to a second wheel assembly 96. Each wheel assembly 94 and 96 extends downwardly from a bottom surface of the top beam 92 and includes a wheel 74 mounted on an arm 75. Formed on a top surface of the top beam 92 are guides 98 that extend vertically upwards and are for blocking overflowing concrete. Disposed beneath and separated from the top beam 92 is a lower support beam 107.

Extending downwardly from the bottom surface of the top beam 92 to the ends of the lower support beam 107 are end supports 100 and 102. The lower support beam 107 and the end supports 100 and 102 are flush to one another. Interposed between the end supports 100 and 102 are interior supports 104 that are disposed in a vertical orientation and extend downwardly from the bottom surface of the top beam 92 to the top surface of the lower support beam 107. The arms 75 are parallel to the end supports 100 and 102 and the interior supports 104. It will be appreciated that the lowermost portion of the end supports 100 and 102 and the interior supports 104 are free hanging to thereby allow the partition 90 to move freely on the wheels 74. Extending laterally between the interior supports 104 and the end supports 100 and 102 are cross-piece members 106. A plurality of vertically spaced apart mounting braces 196 also extend laterally between the interior supports 104 and the end supports 100 and 102. As will be discussed below in greater detail, a plurality of U-shaped slots 198 are formed on each mounting brace 196 for removably attaching a bulkhead to mounting braces 196. In one embodiment, mounting brackets 108 can be disposed on cross-piece members 106 and serve to assist in mounting liners in a manner that will be explained hereinafter.

A liner 110 is shown attached to the partition 90. The liner 110 forms a wall of a cavity into which concrete is poured. The liner 110 may include a forming surface for forming a surface treatment on a concrete panel. The forming surface, such as a mold, may be formed from polyurethane or any other polymeric material. For example, the surface treatment may include any variety of textures or designs, such as designs of rock or brick. Other embodiments of the liner 110 may be substantially smooth, without any particular design. Moreover, some embodiments of the liner 110 may include a continuous pattern or texture configured to extend over an entire panel, such as shown in FIGS. 1 and 2, whereas other embodiments of the liner 110 may have multiple patterns, or be configured to cover only a portion of a panel. Although only one liner 110 is shown attached to the partition 90 in FIG. 5, it will be appreciated that multiple liners may be attached to the partition to thereby extend completely across the partition 90. It will be further appreciated that liners may be mounted completely across the space between the two end supports 100 and 102 of the partition 90 to thereby form a complete wall.

Figure 6:
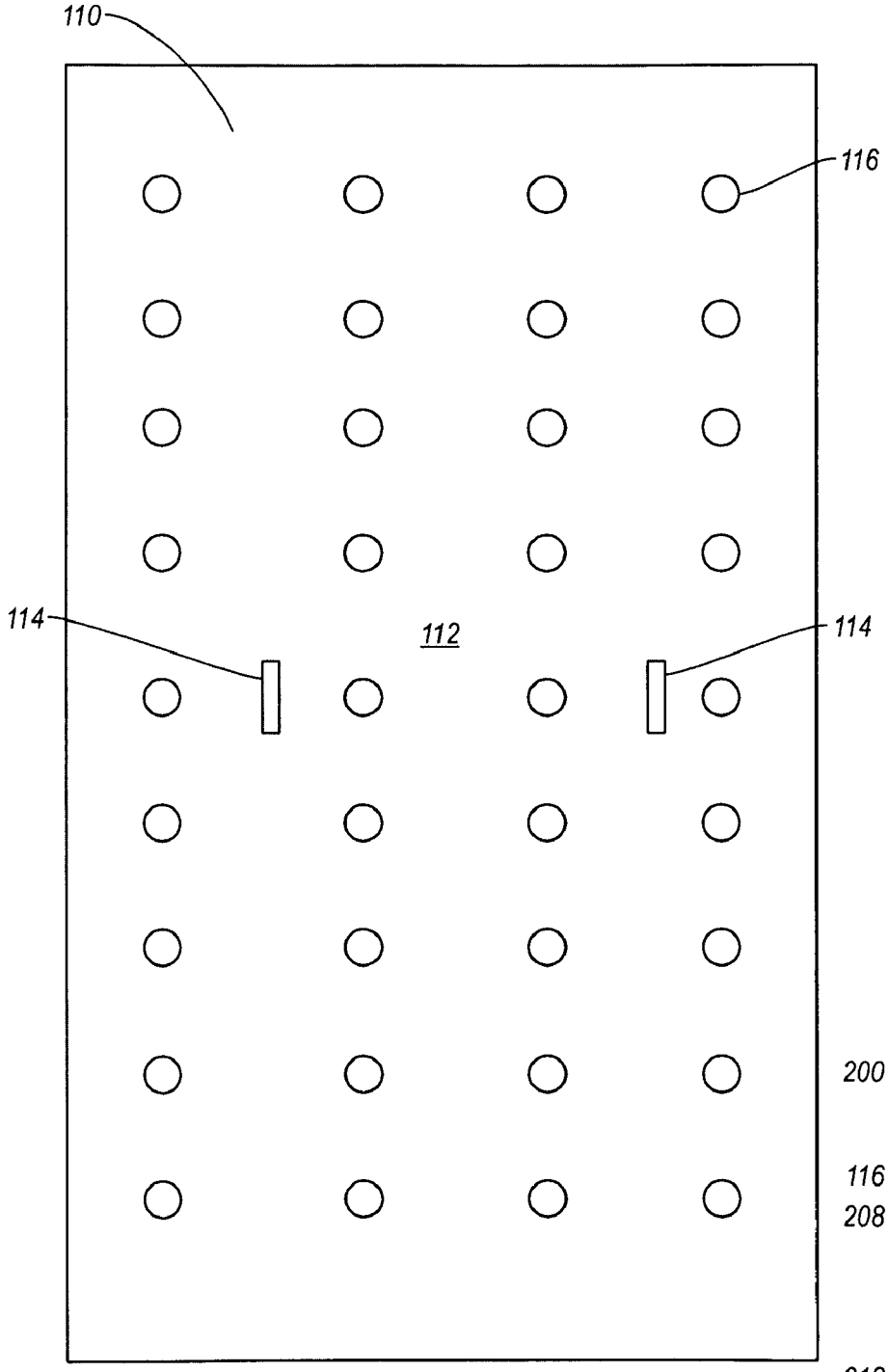
FIG. 6 is a back view of the liner shown installed on the partition in FIG. 5.

Referring now to FIG. 6, there is depicted a back view of the liner 110. The liner 110 includes a rear surface 112 that is substantially flat. Extending from the rear surface 112 are a pair of hooking members 114. The hooking members 114 operate in conjunction with the mounting brackets 108 to facilitate installation of the liner 110 onto the partition 90. Imbedded into the rear surface 112 of the liner 110 are a plurality of magnets 116. The magnets 116 are positioned in the rear surface 112 such that they may engage the partition 90, including the supports 104 and the cross-piece members 106, which are typically formed from a metal. Thus, the magnets 116 are operable to assist in securing the liner 110 to the partition 90 via magnetic coupling.

It will be appreciated that the magnets 116 are completely imbedded into the rear surface 112 so as not to disturb the planar nature of the rear surface 112. That is, a top surface of each of the magnets 116 is flush with the rear surface 112 of the liner 110. In one embodiment, the rear surface 112 of the liner 110 is formed from plywood. To install the magnets 116, circular holes may be drilled into the plywood. The magnets 116 may then be placed into the holes and secured in place using an adhesive such that the rear surface 112 will, when installed onto the partition 90, lie completely flat against the interior supports 104 and/or the cross-piece members 106 of the partition 90.

Figure 6A:
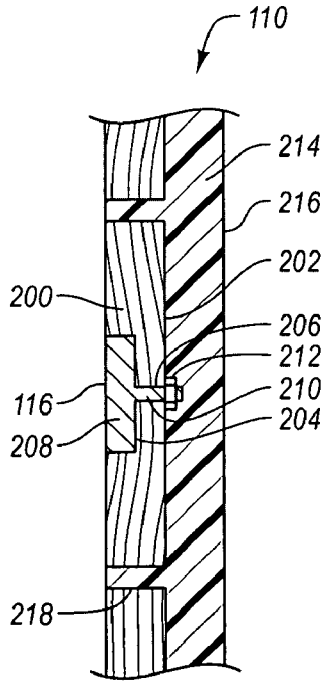
FIG. 6A is a detailed side view of the liner shown in FIG. 6.

For example, depicted in FIG. 6A liner 110 is shown as being comprised of a support member 200 having a front surface 202 and rear surface 112. Support member 200 is typically comprised of a sheet of plywood although other materials can also be used. Recessed bores 204 are formed on rear face 112 with a small diameter passage 206 extending from each bore 204 to front surface 202. Each magnet 116 comprises a body 208 that fits within bore 204. A threaded shaft 210 projects from body 208 through passage 206. A nut 212 and washer are secured on shaft 210 from front surface 202 to thereby secure magnet 116 to support member 200. It is appreciated that other conventional means such as adhesives, screws, press fitting, welding, or the like can be used to secure the magnets.

Liner 110 also comprises a forming layer 214 disposed on front surface 202 of support member 200. As discussed above, forming layer 214 is typically comprised of a flexible polymeric material. Forming layer 214 has a forming surface 216 on which a surface treatment such as texture or design is formed. In one method to secure forming layer 214 to support member 200, holes 218 are drilled through support member 200. As the liquid polymeric material is poured onto front surface 202 of support member 200, the polymeric material passes through holes 218. Once the polymeric material cures, the material within holes 218 secures the remainder of forming layer 214 to support member 200. Again, other conventional mechanisms such as screws, bolts, clamps and adhesives can be used to secure forming layer 214 to support member 200.

In another embodiment, instead of magnets 116, fasteners, such as screws or bolts may be driven through the front of a liner 110 and into the partition 90. The fasteners may be countersunk into the front of the liner 110 and capped to prevent them from impacting the contours of the concrete panels. Nuts may be secured to the bolts.

Figure 7:
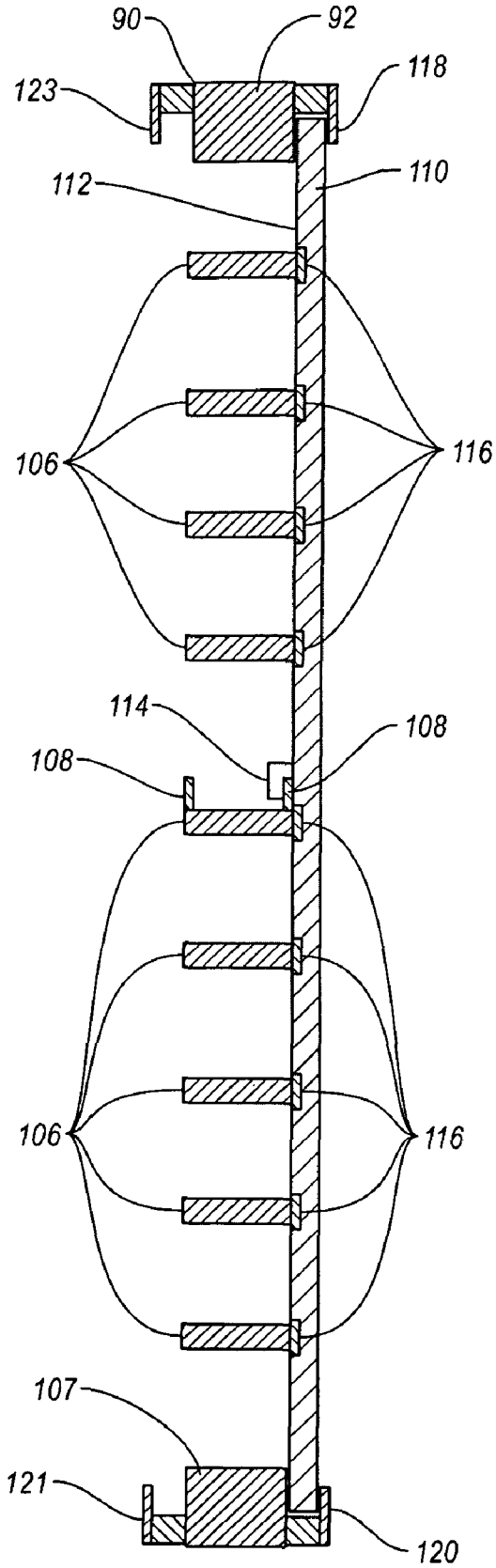
FIG. 7 is a cross-sectional view of the liner depicted in FIGS. 5 and 6 taken along the Section A-A shown in FIG. 5.

In FIG. 7, there is depicted a cross-sectional view of the partition 90 and the liner 110 along the Section A-A shown in FIG. 5, where like reference numerals depict like components. The liner 110 is mounted to the partition 90 via a combination of mechanical securement and magnetic coupling. Extending from the top beam 92 of the partition 90 is a lip 118. Extending from the lower support beam 107 is a lip 120. The spacing of the lips 118 and 120 is such that terminal ends of the liner 110 are able to slide into recesses formed between the lips 118 and 120 and the top beam 92 and the lower support beam 107, respectively. It will be appreciated that the liner 110 may need to be flexed outwardly in order to engage the lips 118 and 120. In addition, the hooking member 114 extending from the rear surface 112 of the liner 110 is shown engaging the mounting bracket 108. The magnets 116 imbedded into the rear surface 112 of the liner 110 engage the cross-piece members 106 of the partition 90 via magnetic coupling.

Interiorly positioned partitions, such as partitions 70B-70D, are able to form panels on both sides. For this reason, an interiorly positioned partition should be able to receive liners on both of its sides. In FIG. 7, the partition 90 is depicted with lips 121 and 123 for allowing liners to be installed on the opposite side of the partition 90 to which liner 110 is attached.

It will be appreciated that the above described manner in which the liner 110 is secured to the partition 90 requires no tools whatsoever to install the liner 110 or to remove the liner 110. This securement method allows for the speedy installation and removal of the liner 110 from the partition 90. Further, liners with different surface treatments can easily be interchanged with each other. Thus, the invention described in the present disclosure reduces the turn around time between concrete pours.

Figure 7A:
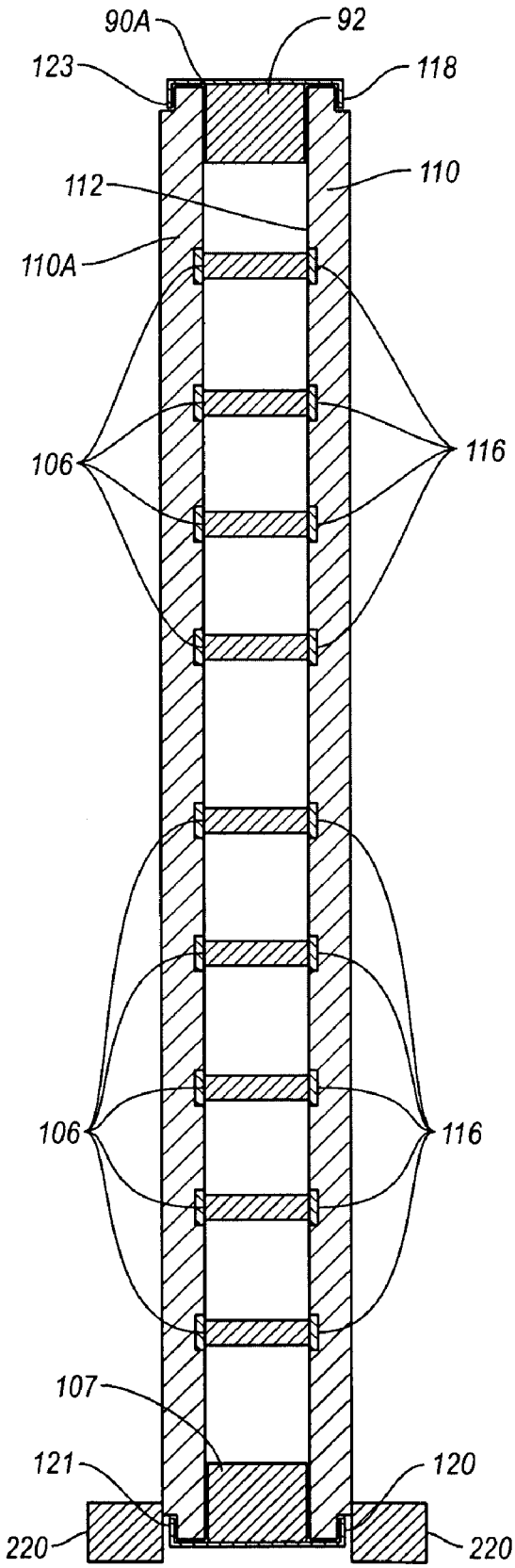
FIG. 7A is a cross-sectional view of an alternative embodiment of the liner and partition shown in FIG. 7.

Depicted in FIG. 7A is an alternative embodiment of a partition 90A. Like elements between partitions 90 and 90A are identified by like reference characters. Partitions 90 and 90A are substantially the same. One difference is that hooks 114 and brackets 108 have been removed so that liner 110 is only attached by magnets 116. Furthermore, lips 118 and 120 are formed by angle irons or channels. The opposing ends of liner 110 are also tapered to fit within the slots formed by lips 118 and 120. Partition 90A also shows a second liner 110A mounted on the side of partition 90A opposite liner 110. Liners 110 and 110A have the same configuration and are mounted in the same method. Finally, FIG. 7A also shows floor seals 220. A floor seal 220 is removably positioned between each adjacent pair of partitions and extends along the length of the partitions. Floor seals 220 are typically comprised of a polymeric material and abut in sealing engagement against the adjacent partitions when the partitions are moved to their desired spacing for forming panels. Floor seals 220 provide a finished surface to the concrete poured thereon and prevent the concrete from leaking out underneath the partitions.

Figure 7B:
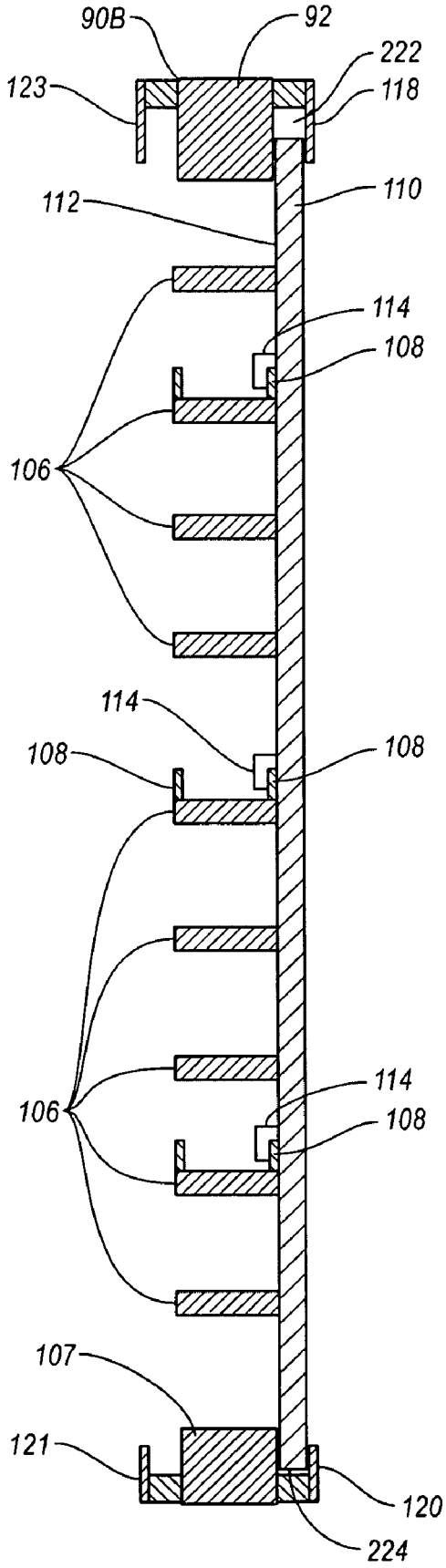
FIG. 7B is a cross-sectional view of an alternative embodiment of the liner and partition shown in FIG. 7.

Depicted in FIG. 7B is an alternative embodiment of a partition 90B. Like elements between partitions 90 and 90B are identified by like reference characters. Partitions 90 and 90B are substantially the same. However, in partition 90B magnets 116 have been removed and liner 110 is secured by a plurality of vertically spaced apart hooks 114 and brackets 108. In this embodiment, an enlarged slot 222 is formed behind lip 118. To insert liner 110, the top end is slid up into slot 118 so that hooks 114 can pass over brackets 108. Liner 110 is then lowered into lower slot 224 behind lip 120 so that hooks 114 engage brackets 108. Lips 118 and 120 are used in part to help ensure that liners 110 do not separate from the partitions when the partitions are separated for removing the concrete panel formed therebetween.

Figure 8:
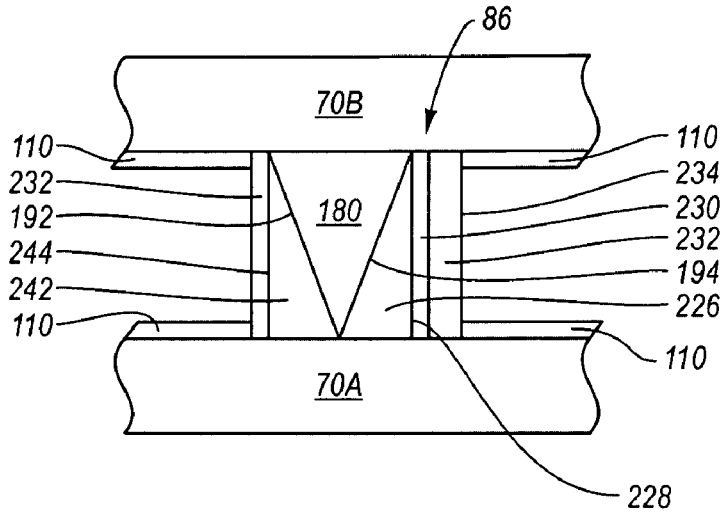
FIG. 8 is a top plan view of a bulkhead shown in FIG. 4.
Figure 9:
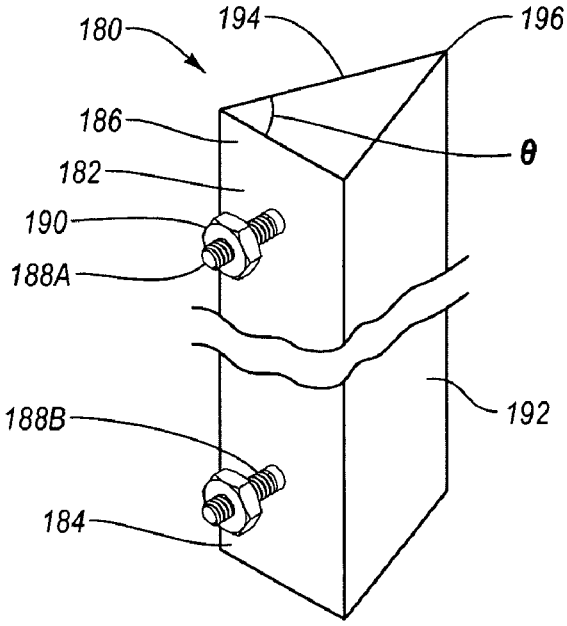
FIG. 9 is a perspective view of the body of the bulkhead shown in FIG. 8.

Depicted in FIG. 8 is a top plan view of one embodiment of bulkhead 86. Bulkhead 86 comprises an elongated centrally body 180 having a wedge shaped transverse cross section. More specifically, as depicted in FIG. 9, body 180 comprises a mounting face 182 that extends between a lower end 184 and an upper end 186. A pair of spaced apart shafts 188A and 188B project from mounting face 182. A fastener 190, such as a threaded nut, is mounted on each shaft 188A and B. Body 180 also includes first side face 192 and an opposing second side face 194 that extend from opposing edges of mounting face 182 and intersect at a leading edge 196. As such, in this embodiment wedge shaped body 180 has a substantially triangular transverse cross section. In an alternative embodiment, leading edge 196 can form a leading face having a width smaller than mounting face 182 so that body 180 has a transverse cross section in the configuration of a trapezoid. In either embodiment, however, the intersection between mounting face 182 and side face 192 and/or side face 194 forms an inside angle θ that is less than 90° and is more commonly in a range between 15° to about 75° with about 30° to about 60° being more common. Other angles can also be used. Body 180 vertically extends from the lower end to the upper end of partition 70B on which it is mounted. Body 180 is mounted to the partition by inserting the shafts 188A and 188B into the U-shaped slots 198 (FIG. 5) that are formed on mounting braces 196. Once shafts 188 A and B are positioned, nuts 190 are tightened, thereby securing body 180 to the partition.

Returning back to FIG. 8, body 180 typically has a width substantially equal to the spacing between the partitions when the partitions are moved to their fixed spacing for forming a panel. Bulkhead 86 further comprises a first insert 226 that is freely positioned adjacent to body 180 and has a length substantially equal to the length of body 180. First insert 226 has a wedge shaped transverse cross sectional configuration that is complementary to the angle of side face 194 of body 180 so that when first insert 226 is positioned against side face 194, first insert has a side face 228 that is now disposed substantially perpendicular to partitions 70A and 70B. Freely positioned adjacent to side face 228 of first insert 226 is a spacer 230 while an end liner 232 is freely positioned adjacent to spacer 230. During some uses, spacer 230 is not required. End liner 232 is typically comprised of a polymeric material and has an inside face 234 that has been finished smooth or with a desired texture so as to properly finish the edge of the panel formed thereat. As will be discussed below in greater detail, liners 110 are mounted on partitions 70A and 70B so as to butt against end liner 232.

As concrete is filled between partitions 70A and 70B, a tremendous load is applied against bulkhead 86. This load can restrict the separation of the partitions once the concrete has cured. By using wedge shaped body 180 and wedge shaped insert 226, which is freely positioned next to body 180, insert 226 can freely slide relative to body 180 as the adjacent partitions are separated, thereby facilitating the separation of the adjacent partitions even when subject to extremely high loads.

If a second panel is going to be formed in the cavity on the side of body 180 opposite of first insert 226, a second insert 242 can be freely positioned against side face 192 of body 180. Again, second insert 242 has a wedge shaped transverse cross sectional configuration that is complementary to the angle of side face 192 of body 180 so that when second insert 242 is positioned against side face 192, second insert 242 has a side face 244 that is now disposed substantially perpendicular to partitions 70A and 70B. Freely positioned adjacent to side face 244 of second insert 242 is a second end liner 232A. A spacer can be positioned between second insert 242 and second end liner 232A but is not required.

Figure 10:
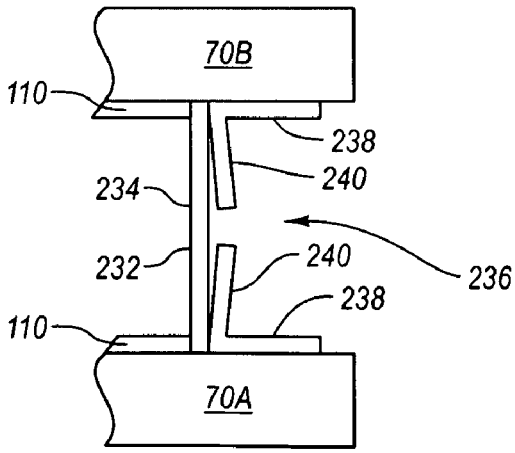
FIG. 10 is a top plan view of a fixed end bulkhead.

It is appreciated that bulkhead 86 can be positioned at each end of the partitions to form the end of the panels. As depicted in FIG. 10, however, partially fixed bulkheads can also be use. For example, depicted in FIG. 10 is a first end of partitions 70A and B having a partially fixed bulkhead 236 formed thereat. Bulkhead 236 comprises a brace 238 secured along the side of each partitions 70A and B so as to vertically extend the height thereof. Each brace 238 includes an arm 240 that projects toward the adjacent partition. Arm 240 slopes slightly away from the cavity in which the panel will be formed to help facilitate release of the partitions after the concrete has hardened. An end liner 232, as discussed above, freely spans between the adjacent partitions and is laterally supported by the adjacent braces 238. End liner 232 properly finishes the edge of the panel formed thereat.

As used herein, the term "vertical manner," when referring to the orientation in which concrete panels are formed, may refer to a length of a concrete panel while being formed in the apparatus 50 of the present disclosure. Specifically, the lateral length of the concrete panel (when in its final, installed position between to columns) is formed in a vertical manner (or up and down manner or a manner that is substantially perpendicular with respect to the ground). That is, the side edges 42 and 44 of the panel 32, while perpendicular to the ground when installed, may be formed parallel to the ground when formed in the apparatus 50. As an obvious consequence of the formation of the lateral length of a concrete panel in a vertical manner, the height of the concrete panel (when in a final, installed position between two columns) is formed substantially parallel with respect to the ground or ground level. That is, the top edge 38 and the bottom edge 40 of the panel 32, while parallel to the ground when installed, may be formed perpendicularly to the ground when formed in the apparatus 50. Thus, the height of the panel 32 may be varied through the use of interior bulkheads 86 as described above. It will be noted that the lateral length of panels is generally the same for most installations since this length is the length between the columns supporting the panels. Thus, it is generally unnecessary to vary the lateral length of a panel. From the above, it will be appreciated that the present disclosure forms a panel in the apparatus 50 in an orientation that is rotated approximately 90 degrees from the orientation in which the panel is installed into a structure.

Conversely, when using the previously available devices, a concrete panel can only be formed in a "horizontal manner" in which the lateral length of the concrete panel is formed substantially parallel to the ground, i.e., in the same orientation that the concrete panel will be installed into a structure.

In use, multiple liners, like the liner 110, may be selected having a surface treatment desired to be placed on panels for use in structures 10 or 30. The partitions 70A-70D may be moved apart to provide access to the partitions 70A-70D. The liners, like the liner 110, may be attached to the partitions 70A-70D using magnetic coupling provided by the magnets 116 imbedded into the liner. At this point, reinforcing steel may be placed in the cavities 76-82 of the apparatus 50, if desired. Interior bulkheads 86 may also be positioned into the cavities 76-82 at the desired height of the panels to be formed. The partitions 70A-70D may then be closed to abut each other and the partitions 70A-70D may be fastened or otherwise secured in place.

More specifically, once the height of a desired panel is determined, this length is measured from the bulkhead at the first end of a partition toward the center of the partition. Body 180 of bulkhead 86 is then secured to the partition, as discussed above, at a location that is closest to but slightly beyond the measured length. Next, liners 110 are mounted on the sides of the adjacent partitions, as discussed above, so that they will cover the full height of the panel. As the partitions are brought together to their desired spacing for forming the panel, floor seal 220 (FIG. 7A) is inserted between the base of the partitions. Likewise, first insert 226 is freely positioned against body 180 while end liners 232 are inserted so as to be located at each end of the panel (FIG. 8). End liners 232 are positioned so that they butt against the end of liners 110. It is recalled that body 180 can only be secured at set locations on the partition based on the location of slots 198 (FIG. 5) that are used for engaging body 180. As such, a gap may exist between end liner 232 and first insert 226 (FIG. 8). If so, spacer 230, which is typically comprised of a rigid foam cut to size but which can be any desired material, is inserted in the space between end liner 232 and first insert 226. Once the partitions are locked in their desired spacing, the concrete can be poured into the cavity that is now bound on each side by liners 110 and on each end by end liners 232.

It is appreciated that one of the benefits of the present invention is the ability to simultaneously form multiple panels at the same time. To simultaneously produce a second panel within the same cavity as the above panel, the height of the second panel is measured from the secured bulkhead 86 toward the second end of the partition. A second body 180 is then secured to the partition at the height of the second panel. The above process of attaching liners 110 and inserting floor seal 220, inserts 226 and 242, and end lines 232 is then accomplished for the cavities forming both panels as the partitions are brought together. This process can be expanded to form three or more panels within one give cavity between two partitions, depending on the desired height for the panels, and can be simultaneously done for each cavity between each adjacent pair of partitions. As such, multiple cavities for simultaneously forming multiple panels between each pair of partitions can be prepared as all of the partitions are secured together at the desired spacing.

Wet concrete may then be poured into the top of the apparatus 50 from above to thereby fill the cavities 76-82. A concrete vibrator may then be used to remove any air pockets in the concrete. To prevent unwanted bowing or flexing of internal partitions 70B-D as the cavities are filled with concrete, the cavities can be progressively filled in stages. For example, in contrast to first filling cavity 76 completely full of concrete and then filling cavity 78, each of cavities 76-82 can first be filled with an incremental amount of concrete, such as three feet. Once the first incremental amount is inserted into each of the cavities, a second incremental amount can be inserted into each of the cavities. This process is repeated until each of the cavities is filled. Using this approach, the partitions are more evenly loaded on opposing sides so as to help avoid unwanted flexing or bending.

Once the concrete has hardened adequately, the partitions 70A-70D may be separated and the panels may be removed. It will be understood that any variety of lifting mechanisms, such as cranes or lifts, may be used to remove the panels from the apparatus 50. Moreover, in some uses of the apparatus 50, it may be beneficial to apply a suitable anti-sticking agent to the liners prior to pouring concrete in the apparatus 50. The purpose of the anti-sticking agent is to facilitate the removal of the panels from the apparatus 50. Once the panels are removed from the apparatus 50, the apparatus 50, and in particular, the liners, may be cleaned and used repeatedly to produce additional panels of the same dimensions. In addition, the liners may be removed and other liners with different surface treatments installed onto the partitions 70A-70D. Further, the interior bulkheads 86 may be removed or adjusted to form panels having varying heights. It will be noted that the wall 84 formed on the rigid members 68 may be adapted to receive liners in a similar manner as explained in relation to the partition 90 and the liner 110 above. In an alternative embodiment, the rigid members 68 may be mounted on a rolling framework similar to the partitions described herein. It will also be noted that the dimensions of the liner 110 may be varied to accommodate different configurations and panel designs. Likewise, by modifying the configuration and/or spacing of the partitions and/or bulkheads, concrete structures other than panels can be formed, such as concrete columns.

Figure 11:
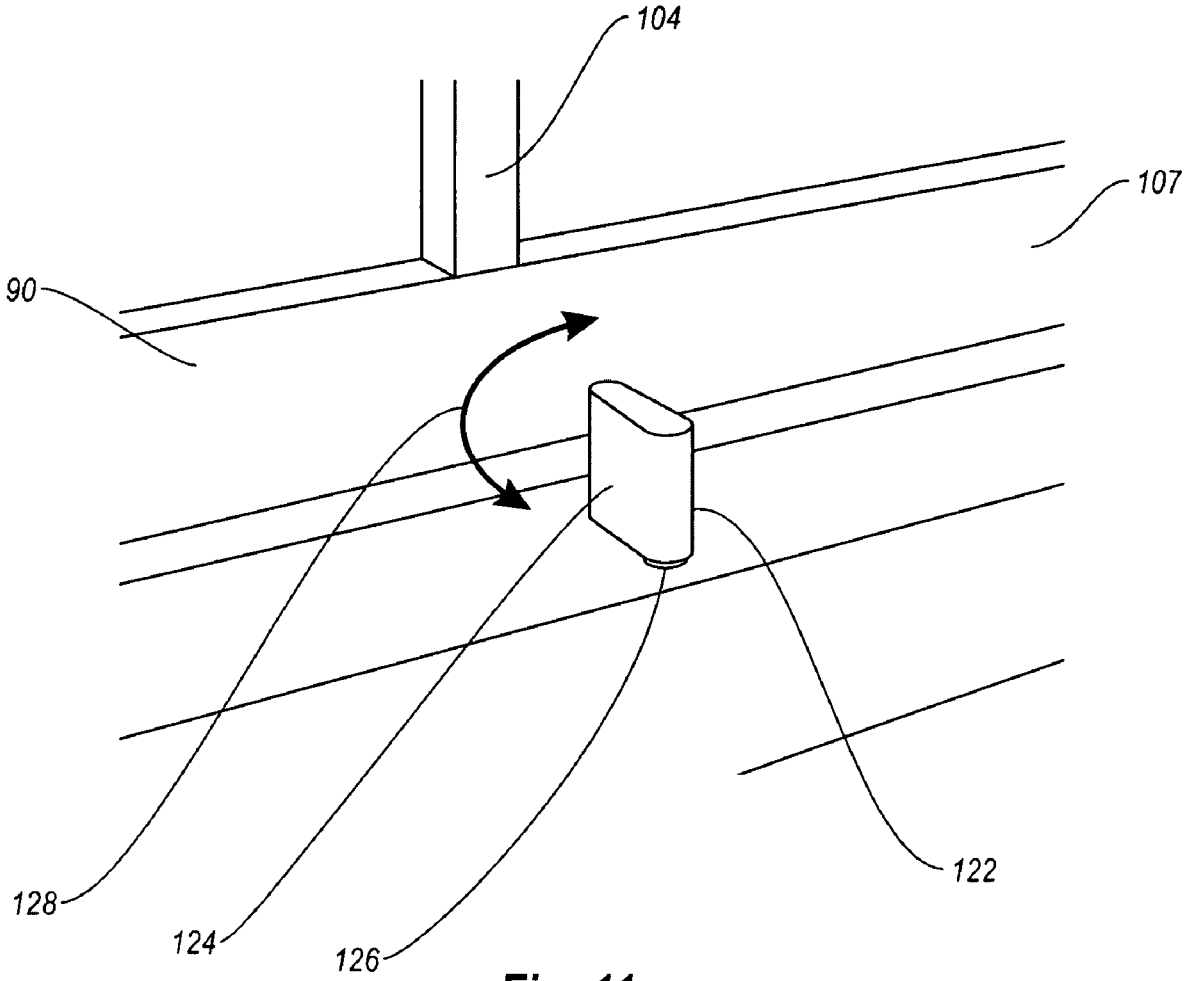
FIG. 11 illustrates a locking peg for locking a partition in place.

Referring now to FIG. 11, there is depicted a locking peg 122 for locking a partition 90 in place on the apparatus 50. The locking peg 122 includes a shaft 126 that is insertable into a hole in the base 54 of the apparatus 50. The locking peg 122 includes a wing 124 that is rotatably positionable as shown by the double arrows indicated with the reference numeral 128. When rotated as shown in FIG. 11, the wing 124 engages the lower end of the partition such as lower support beam 107 such that the wing 124 is perpendicular to and abutting against the partition. To release the partition 90, the wing 124 is rotated away from the lower support beam 107 and the locking peg 122 is removed from the hole in the base. An object, such as a hammer, may be required to strike the wing 124 in order to engage or disengage it from the partition. It will be noted that the locking peg 122 may be only utilized on an outermost partition, such as partition 70A shown in FIG. 4. Where all of the cavities are filled with concrete, partitions 70B-D do not require locking peg 122 because the bottom of each partition is equally loaded so as to preclude movement. In contrast, partition 70A is only loaded on one side.

Figure 12:
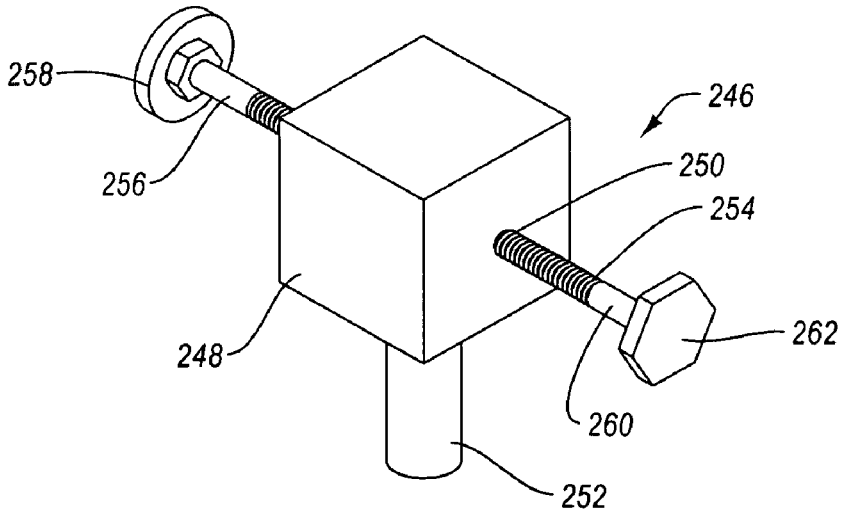
FIG. 12 illustrates a jack for locking a partition in place.

Turning to FIG. 12, in replacement of or in conjunction with locking pegs 122, a jack 246 can be used to position and/or lock in place the bottom end of partition 90. Jack 246 is shown as having a body 248 having a threaded hole 250 extending therethrough and a pin 252 projecting therefrom. Pin 252 is configured to be received within hole 126 on base 54. A threaded shaft 254 is threadedly inserted within hole 250. Shaft 254 has a first end 256 with a brace 258 mounted on the end thereof. Shaft 254 also has a second end 260 with a head 262 mounted thereon. Head 262 is shown as being polygonal so that a wrench or other tool can engage head 262 for rotating shaft 254. With pin 252 received within hole 126, shaft 254 can be rotated so that brace 258 pushes against the lower end of partition 90, which can comprise partition 70A, so as to properly position and/or secure the lower end of the partition. In some embodiments, it is appreciated that a combination of both jacks 254 and locking pegs 122 can be used.

Referring again to FIG. 5, the length of the partition 90, as indicated with the reference numeral 130, in one embodiment is approximately 25 to 30 feet (7.62 to 9.14 meters) and the height, as indicated by the reference numeral 132, is approximately 6 to 15 feet (1.83 to 4.57 meters).

Figure 13:
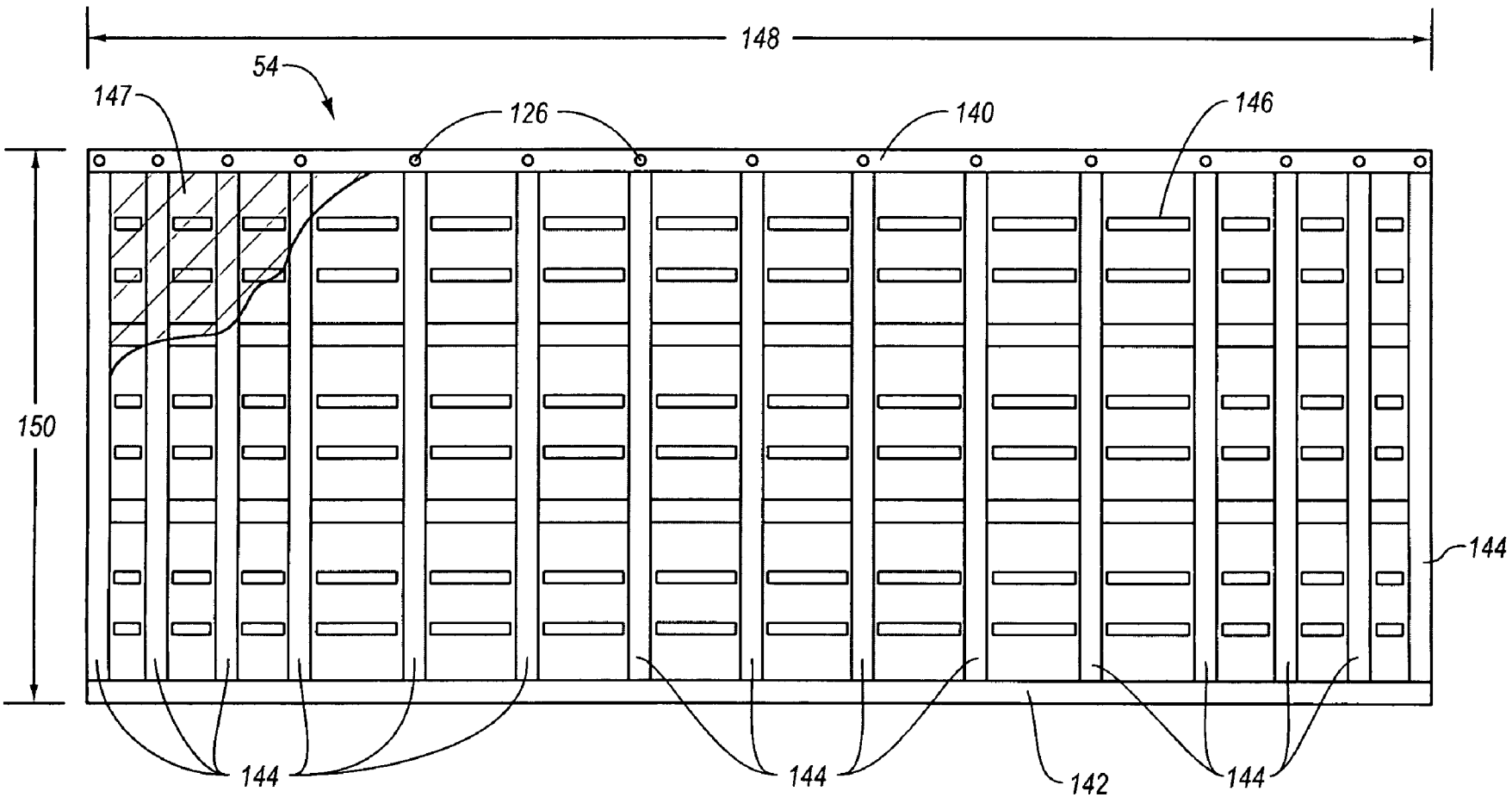
FIG. 13 illustrates a suitable base for an apparatus for forming concrete panels.

Referring now to FIG. 13, there is depicted a top view of a suitable structure for use as base 54 pursuant to one embodiment of the present disclosure. The base 54 may include two opposing side beams 140 and 142. Extending between the side beams 140 and 142 are cross beams 144. Support braces 146 extend between the cross beams 144 to strengthen the base 54. A surface material, indicated by reference numeral 147, may cover the entire base 54 to thereby form a floor. The length of the base 54, as indicated with the reference numeral 148, in one embodiment is approximately 25 to 35 feet (7.62 to 10.69 meters) and the width, as indicated by the reference numeral 150, is approximately 12 to 20 feet (3.66 to 6.10 meters). Holes 126 are show on side beam 140 for receiving jack 246 and/or locking peg 122.

International patent application no. PCT/US2005/039009, which was filed internationally on Oct. 27, 2005, is hereby incorporated by reference in its entirety.

Those having ordinary skill in the relevant art will appreciate the advantages provided by the features of the present disclosure. For example, it is a feature of the present disclosure to provide an apparatus for forming panels for use in physical and sound barriers. Another feature of the present disclosure is to provide such an apparatus that is capable using removable liners secured to the apparatus via magnetic coupling. It is a further feature of the present disclosure, in accordance with one aspect thereof, to provide a cavity with non-permanent bulkheads such that the dimensions of concrete panels formed in the cavity may be varied.

In the foregoing Detailed Description of the Disclosure, various features of the present disclosure are grouped together in a single embodiment for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment. Thus, the following claims are hereby incorporated into this Detailed Description of the Disclosure by this reference, with each claim standing on its own as a separate embodiment of the present disclosure.

It is to be understood that the above-described arrangements are only illustrative of the application of the principles of the present disclosure. Numerous modifications and alternative arrangements may be devised by those skilled in the art without departing from the spirit and scope of the present disclosure and the appended claims are intended to cover such modifications and arrangements. Thus, while the present disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus for forming concrete structures, the apparatus comprising:

a plurality of partitions positioned in a side-by-side arrangement to form at least one cavity, the at least one cavity comprising a first cavity that is formed between two adjacent of said partitions such that concrete is receivable in the first cavity for forming a concrete structure;

a first liner comprising a forming surface that provides a surface treatment for the concrete structure, the first liner being removably attachable to a first one of the adjacent partitions; and a first bulkhead positioned in the first cavity, the first bulkhead comprising a body and a first insert, the body being removably secured to one of the adjacent partitions, and the first insert being slidable relative to the body to facilitate separation of the adjacent partitions to remove the concrete structure formed within the first cavity.

2. The apparatus of claim 1, wherein the plurality of partitions extends between a first end and an opposing second end and between a lower end and an upper end, and each of said partitions has a first side and an opposing second side, and wherein the first bulkhead is vertically disposed within the cavity so as to extend between the lower end and the upper end of the plurality of partitions, the first bulkhead being movable between the first end and the opposing second end of the plurality of partitions.

3. The apparatus of claim 1, further comprising a second bulkhead disposed within the first cavity spaced apart from the first bulkhead.

4. The apparatus of claim 1, wherein the plurality of partitions comprise at least three partitions in side by side arrangement that form at least two cavities.

5. The apparatus of claim 1, further comprising a support frame on which the plurality of partitions are mounted.

6. The apparatus of claim 5, further comprising a wheel assembly movably mounting each end of each partition on the support frame.

7. The apparatus of claim 1, further comprising a plurality of magnets securing the first liner to the first adjacent partition.

8. The apparatus of claim 1, further comprising a second liner removably mounted to the first adjacent partition, the second liner forming a surface treatment for a concrete structure.

9. The apparatus of claim 1, wherein the first adjacent partition comprises at least one recess receiving a terminal end of the first liner mounted thereon.

10. The apparatus of claim 9, wherein the at least one recess comprises a first recess that is located at an upper end of the first adjacent partition and a second recess that is located at a lower end of the first adjacent partition.

11. The apparatus of claim 8, further comprising:

the first adjacent partition comprising at least one bracket; and at least one hooking member extending from a rear surface of the first and second liners, each hooking member engaging the at least one bracket to thereby secure the first and second liners to the first adjacent partition.

12. The apparatus of claim 1, wherein the body and the first insert each has a wedge shaped transverse cross section.

13. The apparatus of claim 1, wherein the first bulkhead further comprises an end liner disposed adjacent to the first insert.

14. The apparatus of claim 13, wherein the first bulkhead further comprises a spacer disposed between the first insert and the end liner.

15. The apparatus of claim 1, wherein the first bulkhead is movable into a plurality of different locations within the first cavity to thereby vary a dimension of the first cavity.

16. The apparatus of claim 1, wherein the first insert abuts a first surface of the body so as to be freely slidable thereagainst.

17. An apparatus for forming concrete structures, the apparatus comprising:

a plurality of partitions positioned in a side-by-side arrangement to form at least one cavity, the at least one cavity comprising a first cavity that is formed between two adjacent of said partitions such that concrete is receivable in the first cavity for forming a concrete structure;

a first liner comprising a forming surface that provides a surface treatment for the concrete structure, the first liner being removably attachable to a first one of the adjacent partitions; and a first bulkhead positioned in the first cavity, the first bulkhead separating the first cavity into first and second portions such that concrete is receivable in the first and second portions of the first cavity for forming separate concrete structures, the first bulkhead comprising:

a body removably secured to one of the adjacent partitions, the body having first and second side surfaces generally facing the first and second portions respectively;

a first insert adjacent to the first side surface, and a second insert adjacent to the second side surface, the first and second inserts being freely slidable relative to the body to facilitate separation of the adjacent partitions to remove the concrete structures formed within the first and second portions of the first cavity.

18. The apparatus of claim 17, wherein the first and second inserts respectively abut the first and second surfaces of the body so as to be freely slidable thereagainst.

19. The apparatus of claim 17, wherein the body and the first and second inserts each has a wedge shaped transverse cross section.

20. The apparatus of claim 17, wherein the first bulkhead further comprises first and second end liners respectively disposed adjacent to the first and second inserts.

21. An apparatus for forming concrete structures, the apparatus comprising:

a plurality of partitions positioned in a side-by-side arrangement to form at least one cavity, the at least one cavity comprising a first cavity that is formed between two adjacent of said partitions such that concrete is receivable in the first cavity for forming a concrete structure;

a first liner removably attachable to a first one of the adjacent partitions, the first liner comprising a forming surface that provides a surface treatment for the concrete structure; and a first bulkhead disposed within the first cavity, the first bulkhead comprising a body and an insert positioned adjacent each other to facilitate separation of the adjacent partitions to remove the concrete structure formed within the first cavity, the body and the insert each having a wedge shaped transverse cross section.

22. The apparatus of claim 21, wherein the wedge shaped body has a substantially triangular transverse cross section.

23. The apparatus of claim 21, wherein the wedge shaped body has a substantially trapezoidal transverse cross section.

24. The apparatus of claim 21, wherein at least one fastener is imbedded into the first liner to attach the first liner to the first adjacent partition such that the first liner is substantially flush with the first adjacent partition.

25. The apparatus of claim 24, wherein the at least one imbedded fastener comprises a plurality of magnets attached to a back portion of the first liner.

26. The apparatus of claim 24, wherein the at least one imbedded fastener comprises a plurality of screws that are countersunk in the first liner, such that the plurality of screws are substantially concealed with respect to the forming surface.

27. The apparatus of claim 24, wherein each of the plurality of partitions comprises at least one bracket and wherein at least one hooking member extends from a rear surface of the first liner such that each hooking member engages the at least one bracket on the first adjacent partition to thereby secure the liner to the first adjacent partition.

28. The apparatus of claim 24, further comprising a second liner and a plurality of third liners, wherein the first adjacent partition has a first side and an opposing second side, and wherein the first liner and the second liner are removably mounted on the first side of the first adjacent partition and the plurality of third liners are removably mounted on the second side of the first adjacent partition.

* * * * *